US008506044B2

(12) United States Patent
Takeda et al.

(10) Patent No.: US 8,506,044 B2
(45) Date of Patent: Aug. 13, 2013

(54) IMAGE RECORDING APPARATUS

(75) Inventors: Kengo Takeda, Inazawa (JP); Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 242 days.

(21) Appl. No.: 13/076,244

(22) Filed: Mar. 30, 2011

(65) Prior Publication Data

US 2011/0292100 A1 Dec. 1, 2011

(30) Foreign Application Priority Data

May 31, 2010 (JP) ..... 2010-125160

(51) Int. Cl.
*B41J 2/165* (2006.01)

(52) U.S. Cl.
USPC ..... 347/33; 347/23; 347/32; 347/36

(58) Field of Classification Search
USPC ..... 347/32–33, 23, 36
See application file for complete search history.

(56) References Cited

U.S. PATENT DOCUMENTS

| | | | | |
|---|---|---|---|---|
| 5,225,852 | A | 7/1993 | Uchida et al. | |
| 6,106,090 | A * | 8/2000 | Uchida et al. | 347/8 |
| 7,588,309 | B2 * | 9/2009 | Nakashima | 347/22 |
| 2007/0263028 | A1 * | 11/2007 | Zengo et al. | 347/33 |
| 2009/0141077 | A1 | 6/2009 | Okada | |

FOREIGN PATENT DOCUMENTS

| | | | |
|---|---|---|---|
| EP | 1364799 | A2 | 11/2003 |
| JP | 2004-136533 | A | 5/2004 |
| JP | 2006-116808 | A | 5/2006 |
| JP | 2006-206279 | A | 8/2006 |
| JP | 2007-076863 | A | 3/2007 |

OTHER PUBLICATIONS

European Patent Office, Extended European Search Report for European Patent Application No. 11159993.2 (counterpart European Application), dated Feb. 28, 2013.

* cited by examiner

*Primary Examiner* — Jason Uhlenhake
(74) *Attorney, Agent, or Firm* — Baker Botts L.L.P.

(57) ABSTRACT

An image recording apparatus including: a head; a conveying member having a support face and configured to convey a recording medium in a conveying direction; a first wiper extending in a direction intersecting the conveying direction; a second wiper extending at least in the conveying direction; a first-wiping driving portion configured to drive the first wiper and the conveying member to perform a first wiping operation; and a second-wiping driving portion configured to drive the second wiper and the conveying member to perform a second wiping operation; and a controller; wherein the controller controls the first-wiping driving portion and the second-wiping driving portion to perform a first cleaning operation including the first wiping operation and the second wiping operation; and wherein the controller controls the second-wiping driving portion such that the second wiper wipes foreign materials remaining on the support face when the first wiper is released from the support face in the first wiping operation.

17 Claims, 8 Drawing Sheets

IMAGE RECORDING APPARATUS

CROSS REFERENCE TO RELATED APPLICATION

The present application claims priority from Japanese Patent Application No. 2010-125160, which was filed on May 31, 2010, the disclosure of which is herein incorporated by reference in its entirety.

BACKGROUND OF THE INVENTION

1. Field of the Invention

The present invention relates to an image recording apparatus configured to record an image on the recording medium.

2. Description of the Related Art

There is known a cleaning device including a blade for wiping ink attached to a face of a convey belt. The blade of this cleaning device is fixed to a pivotably supported blade supporting member so as to be moved toward and away from the face of the convey belt.

SUMMARY OF THE INVENTION

However, in the above-described cleaning device, when the blade is released or moved off from the face of the convey belt after the ink attached on the face of the convey belt has been wiped by the blade, ink not having been wiped or removed by the blade remain on the face of the convey belt. Thus, when the recording medium is conveyed by the convey belt, the remaining ink may be disadvantageously attached to the recording medium and soil the recording medium.

This invention has been developed in view of the above-described situations, and it is an object of the present invention to provide an image recording apparatus in which foreign materials are less likely to remain on a face of a conveying member.

The object indicated above may be achieved according to the present invention which provides An image recording apparatus including a wiping mechanism for wiping a conveying member, the image recording apparatus comprising: a head configured to eject liquid onto a recording medium; the conveying member which has a support face facing the head and which is configured to convey the recording medium in a conveying direction by moving the support face supporting the recording medium thereon in the conveying direction; a first wiper extending in a direction intersecting the conveying direction; a second wiper extending at least in the conveying direction; a first-wiping driving portion configured to drive the first wiper and the conveying member to perform a first wiping operation for: adjusting a position of the conveying member; bringing a distal end of the first wiper located at a position distant from the support face, into contact with the support face; and moving the first wiper and the support face relative to each other in the conveying direction; a second-wiping driving portion configured to drive the second wiper and the conveying member to perform a second wiping operation for: adjusting the position of the conveying member; bringing a distal end of the second wiper located at a position distant from the support face, into contact with the support face; and moving the second wiper and the support face relative to each other in a direction intersecting the conveying direction; and a controller configured to control the first-wiping driving portion and the second-wiping driving portion; wherein the controller is configured to control the first-wiping driving portion and the second-wiping driving portion to perform a first cleaning operation including the first wiping operation and the second wiping operation which is performed after a completion of the first wiping operation; and wherein the controller is configured to control the second-wiping driving portion in the second wiping operation such that the second wiper wipes the support face to remove a foreign material remaining on the support face when the first wiper is released from the support face in the first wiping operation.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
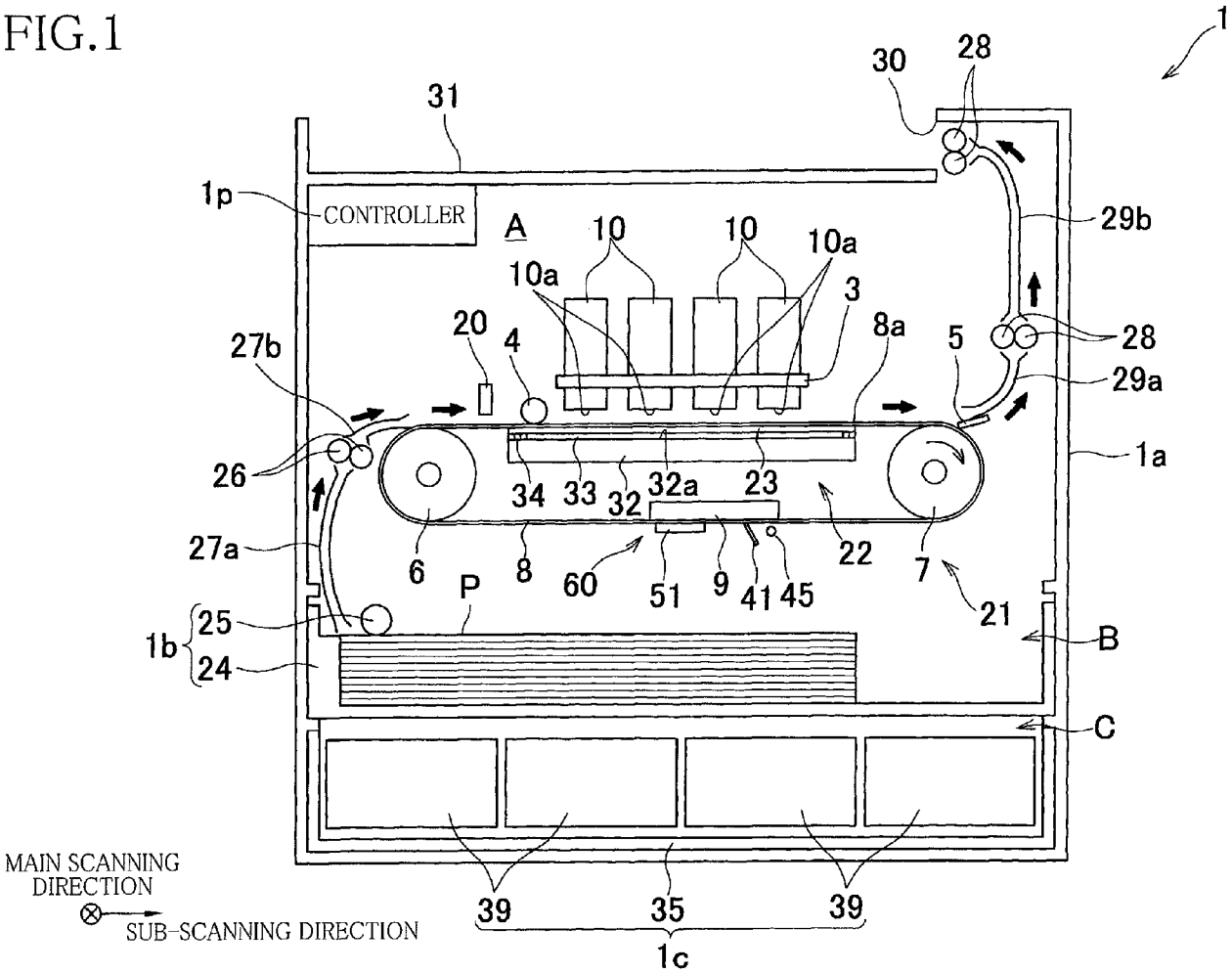
FIG. 1 is a side view generally showing an overall construction of an ink-jet printer as an embodiment of the present invention.

Hereinafter, there will be described an embodiment of the present invention by reference to the drawings.

First, there will be explained an overall construction of an ink-jet printer 1 as an embodiment of an image recording apparatus to which the present invention is applied, with reference to FIG. 1.

The printer 1 includes a casing 1*a* having a rectangular parallelepiped shape. A sheet-discharge portion 31 is provided at an upper portion of a top plate of the casing 1*a*. An inner space of the casing 1*a* is divided into spaces A, B, and C in order from an upper side thereof. In the spaces A, B is formed a sheet conveying path which is continuous to the sheet-discharge portion 31. In the space C, four cartridges 39 are accommodated. Each of the four cartridges 39 can store an ink to be supplied to a corresponding one of four ink-jet heads 10, that is, each cartridge 39 functions as an ink supply source for the corresponding ink-jet head 10.

In the space A, there are arranged the four heads 10, a sheet-convey unit 21, a maintenance unit 60, a guide unit, and so on. The four heads 10 respectively eject the inks of respective four colors, namely, magenta, cyan, yellow, and black. The sheet-convey unit 21 conveys or feeds a recording medium such as a sheet P in a conveying direction (a direction from a left side toward a right side in FIG. 1). The maintenance unit 60 is provided near a lower end of the sheet-convey unit 21. The guide unit is for guiding the sheet P. In the space A, there is disposed a controller 1*p* configured to control operations of components of the printer 1 to control an overall operation of the printer 1.

The controller 1*p* controls a recording operation on the basis of image data supplied or transmitted from an external device. Examples of the recording operation include a conveying operation for conveying the sheet P, an ejecting operation for ejecting the ink in synchronization with the conveying operation, and so on. The controller 1*p* executes a maintenance processing to perform a maintenance operation by controlling the sheet-convey unit 21 and the maintenance unit 60 on the basis of a wiping command. Here, the maintenance operation is a series of operations including a wiping for removing foreign materials (such as the ink and sheet powder) on a support face 8*a* of a sheet-convey belt 8 as one example of a conveying member. The control of the maintenance operation will be explained in detail later with reference to FIG. 8.

The sheet-convey unit 21 includes: (a) belt rollers 6, 7; (b) the endless sheet-convey belt 8 wound around the rollers 6, 7; (c) a nip roller 4 and a peeling plate 5 disposed outside the sheet-convey belt 8; (d) an adsorption platen 22 disposed inside the sheet-convey belt 8; and so on. The belt roller 7 is a drive roller which is rotated in a clockwise direction in FIG. 1 by a drive power of a sheet-convey motor 121 (see FIG. 6) driven by the controller 1*p*. The rotation of the belt roller 7 rotates or circulates the sheet-convey belt 8 in a direction indicated by bold arrows in FIG. 1. The belt roller 6 is a driven roller which is rotated in the clockwise direction in FIG. 1 in accordance with the rotation of the sheet-convey belt 8.

Figure 2:
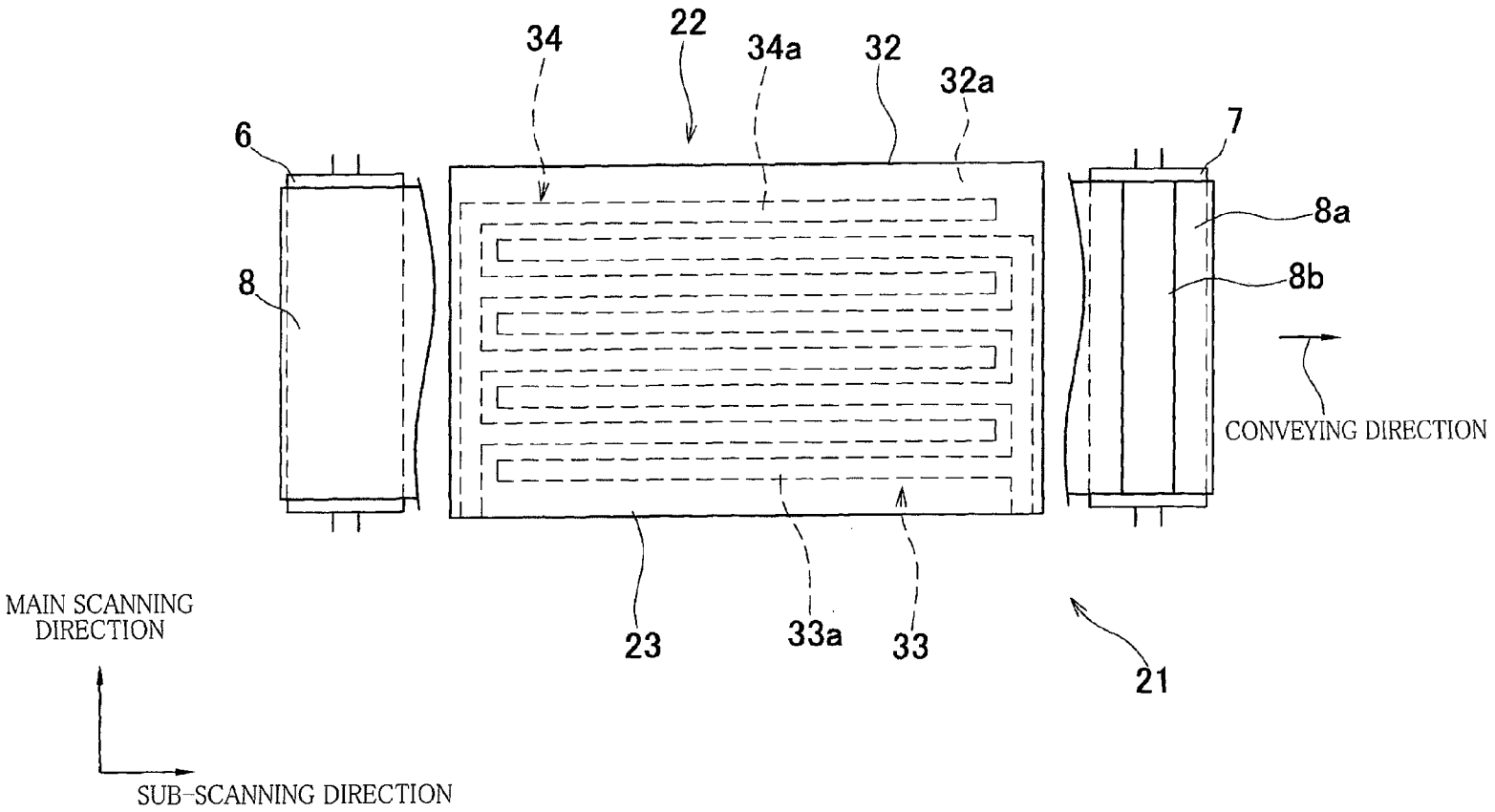
FIG. 2 is a plan view generally showing a sheet-convey unit shown in FIG. 1

The sheet-convey belt 8 is formed of, e.g., polyimide and a fluorocarbon resin and has a volume resistivity of about between $10^8$ and $10^{14}$ Ω·cm (ohm·cm), and has a flexibility. However, any material may be used for the sheet-convey belt 8 as long as the sheet-convey belt 8 has a volume resistivity and a flexibility similar to the above. As shown in FIG. 2, a liquid repellent area 8*b* extending in a main scanning direction is formed on the support face 8*a* of the sheet-convey belt 8. The liquid repellent area 8*b* has been subjected to liquid repellent coating by a fluorocarbon resin or a silicon water repellent agent, so that the liquid repellent area has a higher liquid repellency than that of the other area of the support face 8*a*. It is noted that, where the sheet-convey belt 8 is formed of the fluorocarbon resin, the coating is performed on the liquid repellent area 8*b* by a fluorocarbon resin containing more fluorine than the fluorocarbon resin of the sheet-convey belt 8. The liquid repellent area 8*b* is formed so as to expand over an entire width of the sheet-convey belt 8 in the main scanning direction. Further, the liquid repellent area 8*b* is formed so as to have a length shorter in the sub-scanning direction than that of a sub-wiper 51 which will be described below.

Here, the sub-scanning direction is a direction parallel to the conveying direction of the sheet P, and the main scanning direction is a direction parallel to a horizontal plane and perpendicular to the sub-scanning direction.

As shown in FIGS. 1 and 2, the adsorption platen 22 includes: a plate-like base material (member) 32 formed of an insulating material; two electrodes 33, 34 bonded on an upper face 32*a* of the base material 32; a protective film 23 bonded on the upper face 32*a* so as to cover an entire area of the electrodes 33, 34. The adsorption platen 22 is disposed so as to face the heads 10, with the sheet-convey belt 8 interposed therebetween. The adsorption platen 22 supports an upper portion of the sheet-convey belt 8 from an inside thereof. The electrode 33 includes a plurality of elongated portions 33*a* extending in the sub-scanning direction (i.e., the conveying direction). The electrode 34 includes a plurality of elongated portions 34*a* extending in the sub-scanning direction. Each of the electrodes 33, 34 has a comb-like shape such that these elongated portions 33*a*, 34*a* are alternately arranged one by one in the main scanning direction. Further, the electrodes 33, 34 are connected to a power source 36 (see FIG. 6) provided in the casing 1*a*. It is noted that the power source 36 is controlled by the controller 1*p*. The adsorption platen 22 and the power source 36 constitute an adsorption portion for adsorbing or attracting the sheet P to the support face 8*a* of the sheet-convey belt 8.

The protective film 23 is formed of, e.g., polyimide and a fluorocarbon resin and has a volume resistivity of about between $10^8$ and $10^{14}$ Ω·cm (ohm·cm), and has a flexibility. However, any material may be used for the protective film 23 as long as the protective film 23 has a volume resistivity and a flexibility similar to the above.

The nip roller 4 is disposed on an upstream end of the adsorption platen 22 at a position facing the elongated portions 33*a*, 34*a* of the respective electrodes 33, 34. The nip roller 4 presses the sheet P supplied from a sheet-supply unit 1*b*, onto the support face 8*a* of the sheet-convey belt 8.

In this configuration, the belt roller 7 is rotated in the clockwise direction in FIG. 1 by the control of the controller 1*p*, thereby rotating the sheet-convey belt 8. In this operation, the belt roller 6 and the nip roller 4 are also rotated in accordance with the rotation of the sheet-convey belt 8. Further, in this operation, different potentials are respectively applied to the electrodes 33, 34 by the control of the controller 1*p*. For example, a positive or a negative potential is applied to the electrode 33, and a ground potential is applied to the electrode 34.

Figure 3:
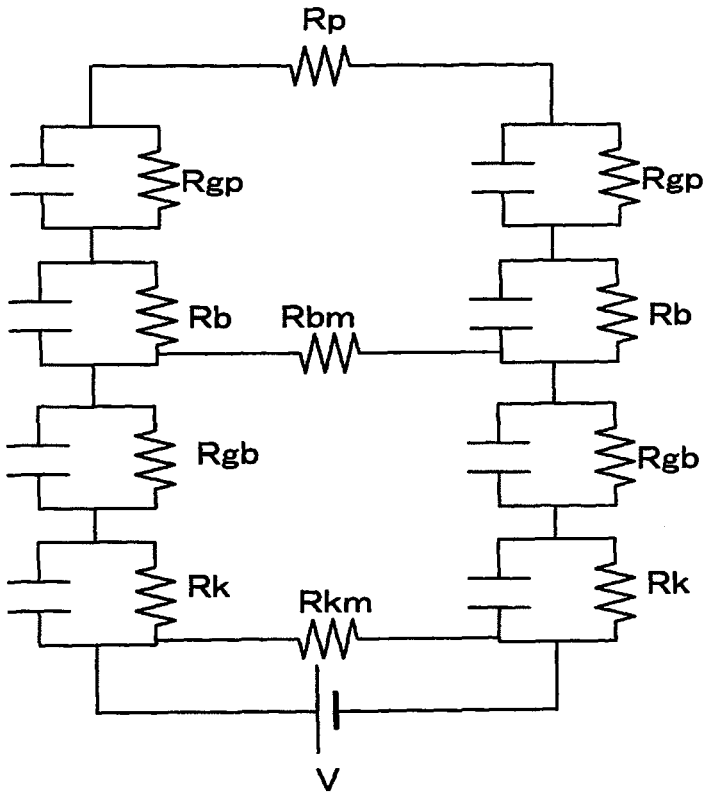
FIG. 3 is an electric circuit diagram showing an electric circuit formed by the sheet-convey unit shown in FIG. 2.

That is, when the voltage is applied to between the electrodes 33, 34, a current flows to between the electrodes 33, 34 via the sheet-convey belt 8 and the sheet P. FIG. 3 shows an electric circuit formed when a voltage V is applied to between the electrodes 33, 34. It is noted that the electric circuit shown in FIG. 3 is merely one model which is assumed where the present embodiment is idealized as an electric construction.

This electric circuit includes a path passing through the electrode 33, the sheet-convey belt 8, the sheet P, the sheet-convey belt 8, and the electrode 34 in order. Signs Rk, Rgb, Rb, Rgp, and Rp in FIG. 3 respectively denote electric resistances of respective points in this path. Specifically, the sign Rk corresponds to an electric resistance of the protective film 23 between the electrodes 33, 34 and the sheet-convey belt 8. The sign Rgb corresponds to an electric resistance of a clearance between the protective film 23 and the sheet-convey belt 8. The sign Rb corresponds to an electric resistance of the sheet-convey belt 8. The sign Rgp corresponds to an electric resistance of a clearance between the sheet-convey belt 8 and the sheet P. The sign Rp corresponds to an electric resistance in the sheet P.

This electric circuit includes alternative paths connected to the above-described path in parallel. Signs Rkm and Rbm respectively denote electric resistances of the alternative paths. Specifically, the sign Rkm denotes an electric resistance of an alternative path directly connecting the electrodes 33, 34 to each other only via the protective film 23. The sign Rbm denotes an electric resistance of an alternative path connecting a side of the electrode 33 and a side of the electrode 34 to each other not via the sheet P but via the sheet-convey belt 8.

As shown in FIG. 3, where a voltage is applied to between the electrodes 33, 34, electric charges are accumulated on and in the above-described components and clearances, thereby forming a condenser connected to the electric resistances in parallel. When a minute current for charging the condenser flows to the clearance between the sheet P and the sheet-convey belt 8, an electric field is generated in this clearance. As a result, an attractive (adsorptive) force called "Johnsen- Rahbeck force" is generated in between the sheet P and the sheet-convey belt 8. This attractive force causes the sheet P on the sheet-convey belt 8 to be electrostatically adsorbed to the support face 8*a*.

In this manner, the sheet P supplied from the sheet-supply unit 1*b* is conveyed in the conveying direction while being attracted and adsorbed to the support face 8*a* by the attractive force generated by the adsorption platen 60. In this operation, when the sheet P conveyed while being adsorbed onto the support face 8*a* passes through the positions just under the four ink-jet heads 10 (i.e., areas facing ejection faces 10*a* of the respective heads 10) in order, the controller 100 controls the heads 10 to eject the inks of respective colors onto the sheet P. As a result, a desired color image is formed on the sheet P. The peeling plate 5 is disposed so as to face the belt roller 7 and configured to peel off the sheet P from the support face 8*a* to guide the sheet P toward a downstream side in the conveying direction.

The maintenance unit 60 includes a main wiper 41 (as one example of a first wiper), the sub-wiper 51 (as one example of a second wiper), a wiper cleaner 45, and so on. Components of the maintenance unit 60 are disposed at a position facing a lower portion of the sheet-convey belt 8. A platen 9 is disposed inside the sheet-convey belt 8 at a position facing the wipers 41, 51, with the sheet-convey belt 8 interposed between the platen 9 and the wipers 41, 51. The platen 9 supports the lower portion of the sheet-convey belt 8 from the inside thereof. The platen 9 prevents the sheet-convey belt 8 from bending or flexing due to the wipers 41, 51 when the wipers 41, 51 remove the foreign materials, making it possible to effectively retain a wiping performance. The construction of the maintenance unit 60 will be explained in greater detail below with reference to FIGS. 4 and 5.

As shown in FIG. 1, each of the heads 10 is a line head having a generally rectangular parallelepiped shape elongated in a main scanning direction in which each head reciprocates. Each head 10 has a lower face functioning as an ejection face 10*a* having a multiplicity of ejection openings formed therein. When image recording (image forming) is performed, each head 10 ejects an ink of a corresponding one of four colors, namely, black (K), magenta (M), cyan (C), and yellow (Y), from the corresponding ejection face 10*a*. The heads 10 are supported by the casing 1*a* via a head holder 3 so as to be arranged at predetermined pitches in a sub-scanning direction which is perpendicular to the main scanning direction. The head holder 3 holds the heads 10 such that the ejection faces 10*a* face the support face 8*a* of the upper portion of the sheet-convey belt 8 so as to provide a specific space suitable for the recording between the support face 8*a* and the ejection faces 10*a*.

The guide unit includes an upstream guide portion and a downstream guide portion arranged respectively on opposite sides of the sheet-convey unit 21. The upstream guide portion includes two guides 27*a*, 27*b* and a pair of sheet-convey rollers 26 and connects between the sheet-convey unit 21 and a sheet-supply unit 1*b* which will be described below. The downstream guide portion includes two guides 29*a*, 29*b* and two pairs of sheet-convey rollers 28 and connects between the sheet-convey unit 21 and the sheet-discharge portion 31.

In the space B, the sheet-supply unit 1*b* is disposed so as to be attachable to and detachable from the casing 1*a*. The sheet-supply unit 1*b* includes a sheet-supply tray 24 and a sheet-supply roller 25. The sheet-supply tray 24 has a box-like shape opening upward and accommodates a plurality of sheets P of various sizes. The sheet-supply roller 25 supplies, to the upstream guide portion, an uppermost one of the sheets P accommodated in the sheet-supply tray 24.

As described above, in the spaces A, B is formed the sheet conveying path extending from the sheet-supply unit 1*b* to the sheet-discharge portion 31 via the sheet-convey unit 21. The controller 1*p*, on the basis of a recording command received from the external device, drives a plurality of motors such as a sheet-supply motor 125 for the sheet-supply roller 25 (see FIG. 6), a sheet-convey motor 127 for the sheet-convey rollers of each guide portion (see FIG. 6), the sheet-convey motor 121 (see FIG. 6), and the like. The sheet P supplied from the sheet-supply tray 24 is fed or conveyed to the sheet-convey unit 21 by the sheet-convey rollers 26. In this conveyance, the controller 1*p* controls the power source 36 as described above to adsorb, to the support face 8*a*, the sheet P conveyed on the sheet-convey belt 8. When the sheet P passes through the positions just under the heads 10, the heads 10 eject the inks of the respective four colors in order, to form a color image on the sheet P. It is noted that the ink ejecting operation is performed on the basis of a detection signal outputted from a sheet sensor 20. The sheet P is then peeled by the peeling plate 5 and conveyed upward by the sheet-convey rollers 28. The sheet P is then discharged onto the sheet-discharge portion 31 through an opening 30.

In the space C, a cartridge unit 1*c* is disposed so as to be attachable to and detachable from the casing 1*a*. The cartridge unit 1*c* includes a tray 35 and the four cartridges 39 accommodated in the tray 35 so as to be arranged in a row. Each of the cartridges 39 stores the ink of the corresponding color. Each cartridge 39 supplies the ink to the corresponding head 10 via a tube, not shown.

Figure 4:
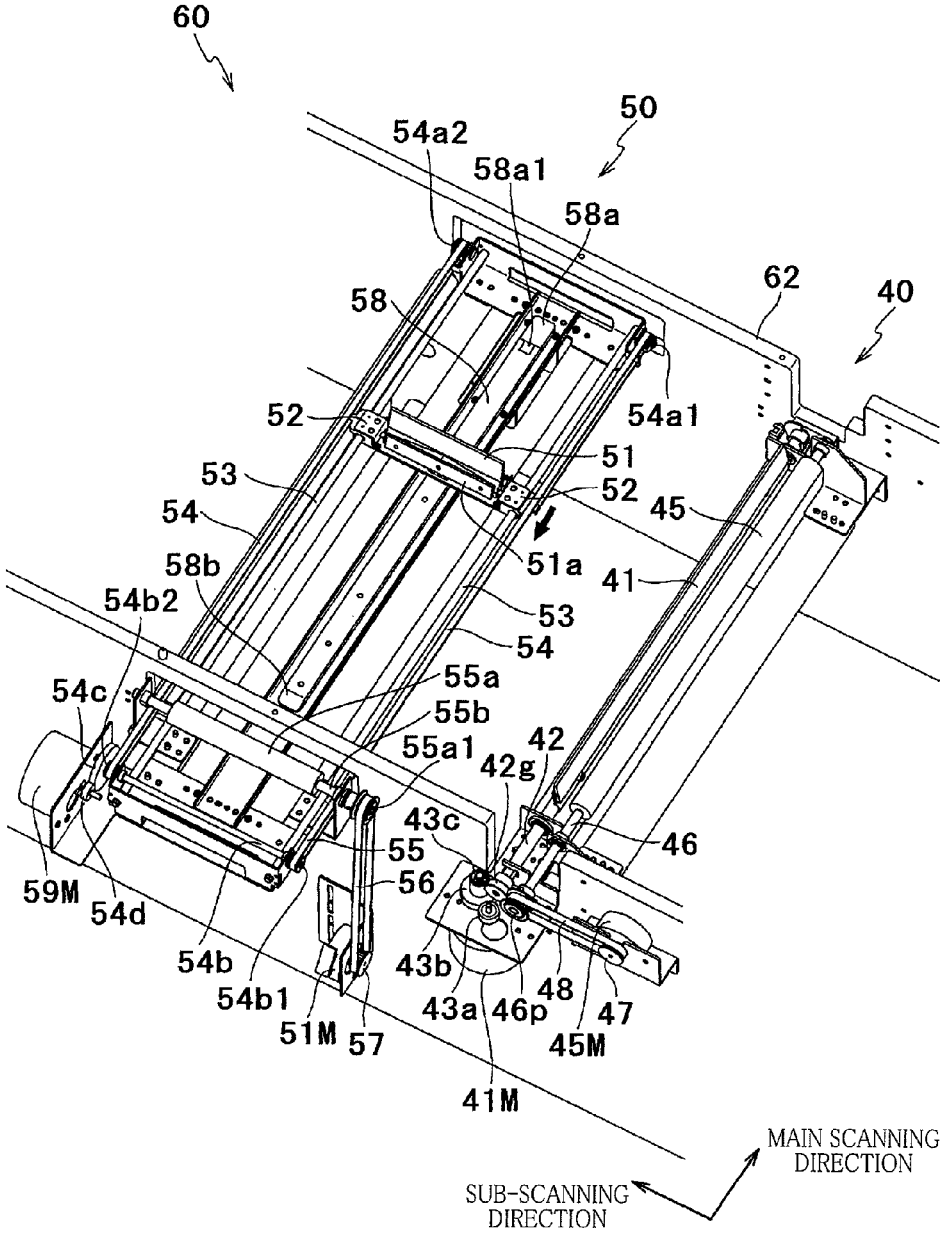
FIG. 4 is a perspective view generally showing a maintenance unit shown in FIG. 1.

There will be next explained the construction of the maintenance unit 60 in greater detail with reference to FIGS. 4 and 5A-5G. As shown in FIG. 4, the maintenance unit 60 includes a main wiping mechanism 40 (as one example of a first-wiping driving portion) and a sub-wiping mechanism 50 (as one example of a second-wiping driving portion).

The main wiping mechanism 40 includes the main wiper 41 and the wiper cleaner 45. The main wiper 41 is a plate-like member formed of an elastic material such as a rubber and extending in the main scanning direction. The main wiper 41 is used for a first wiping operation which will be described below. A basal end (a lower end) of the main wiper 41 is fixed to an outer circumferential face of a shaft 42. The shaft 42 extends in the main scanning direction and is supported by a frame 62 so as to be rotatable together with the main wiper 41 about an axis extending in the main scanning direction. The frame 62 is fixed to the casing 1*a* (see FIG. 1).

The main wiping mechanism 40 includes a gear 43*a*, a gear 43*b* and a worm gear 43*c* as components for rotating the shaft 42. The gear 43*a* is fixed to an output shaft of a motor 41M, the gear 43*b* is meshed with the gear 43*a*, and the worm gear 43*c* is rotated with a rotation of the gear 43*b*. On one end of the shaft 42 is provided a worm wheel 42*g* which is meshed with an outer circumferential face of the worm gear 43*c*. A drive of the motor 41M rotates the gears 43*a*, 43*b*, 43*c*, thereby rotating the worm wheel 42*g*. As a result, the shaft 42 is rotated about the axis extending in the main scanning direction, thereby changing an angle of inclination (an inclination angle) of the main wiper 41 with respect to the horizontal plane.

The inclination angle of the main wiper 41 is controlled by the controller 1*p* such that a distal end portion of the main wiper 41 contacts the support face 8*a* of the sheet-convey belt 8 while bending in a first wiping operation and such that a distal end of the main wiper 41 is distant from the support face 8*a* of the sheet-convey belt 8 at times other than the first wiping operation. Further, the inclination angle of the main wiper 41 is controlled by the controller 1*p* such that the distal end of the main wiper 41 is distant from the wiper cleaner 45 at times other than a wiper cleaning which will be described below.

Further, a length of the main wiper 41 in the main scanning direction is slightly larger than the width of the sheet-convey belt 8 in the main scanning direction, and the main wiper 41 is disposed so as to extend over an entire width of the sheet-convey belt 8. That is, the main wiper 41 is disposed such that a center thereof in the main scanning direction coincides with a center of the sheet-convey belt 8 in a widthwise direction thereof and such that the main wiper 41 projects from opposite ends of the sheet-convey belt 8 in the widthwise direction thereof in plan view. Thus, the distal end of the main wiper 41 contacts the entire width of the sheet-convey belt 8 in the wiping operation.

The wiper cleaner 45 is used for the wiper cleaning and formed, e.g., by an absorber material such as a sponge. The wiper cleaner 45 has a cylindrical shape extending in the main scanning direction and is supported by a shaft 46 extending in the main scanning direction. The shaft 46 is supported by the frame 62 so as to be rotatable together with the wiper cleaner 45 about an axis extending in the main scanning direction.

The main wiping mechanism 40 includes a pulley 47, a pulley 46*p*, and a belt 48 as components for rotating the shaft 46. The pulley 47 is fixed to an output shaft of a motor 45M, the pulley 46*p* is fixed to one end of the shaft 46, and the belt 48 is wound around the pulley 46*p* and the pulley 47. When the pulley 47 is rotated with a drive of the motor 45M, the belt 48 is rotated or circulated, which rotates the pulley 46*p*. As a result, the shaft 46 is rotated together with the wiper cleaner 45 about the axis extending in the main scanning direction.

The sub-wiping mechanism 50 includes the sub-wiper 51 and a sub-wiper cleaner 55*a*. The sub-wiping mechanism 50 is disposed on a downstream side of the main wiping mechanism 40 in a direction in which the sheet-convey belt 8 runs or is rotated when the sheet P is conveyed in the conveying direction by the sheet-convey belt 8. The sub-wiper 51 is a plate-like member formed of an elastic material such as a rubber and extending in the sub-scanning direction. The sub-wiper 51 is used for a second wiping operation which will be described below. A length of the sub-wiper 51 in the sub-scanning direction is slightly longer than a length of the liquid repellent area 8*b* in the sub-scanning direction. A basal end (a lower end) of the sub-wiper 51 is fixed to a wiper supporter 51*a*. The wiper supporter 51*a* extends in the sub-scanning direction and is supported by the frame 62 so as to be movable in the main scanning direction and rotatable together with the sub-wiper 51 about an axis extending in the sub-scanning direction. A pair of sliders 52 are provided respectively on opposite ends of the wiper supporter 51*a* in the sub-scanning direction. The wiper supporter 51*a* is supported by the sliders 52 so as to be rotatable about an axis extending in the sub-scanning direction. It is noted that the sub-wiper 51 and the wiper supporter 51*a* are urged by an urging member, not shown, such as a spring in a clockwise direction in FIG. 5A. The sliders 52 are respectively supported by a pair of bars 53 so as to be movable in the main scanning direction. The bars 53 extend in the main scanning direction respectively through the sliders 52.

The sub-wiping mechanism 50 includes a pair of belts 54, pulleys 54*a*1, 54*a*2, a roller 54*b*, and pulleys 54*b*1, 54*b*2 as components for moving the sub-wiper 51 in the main scanning direction. The pair of belts 54 are respectively fixed at lower portions thereof to the sliders 52, the pulleys 54*a*1, 54*a*2 are pulleys around which the belts 54 are respectively wound, the roller 54*b* has opposite end portions around which the belts 54 are respectively wound, and the pulleys 54*b*1, 54*b*2 are respectively provided on the opposite end portions of the roller 54*b*. The sub-wiping mechanism 50 further includes a gear 54*c* and a gear 54*d* as the components for moving the sub-wiper 51 in the main scanning direction. The gear 54*c* is rotated integrally with the pulley 54*b*2, and the gear 54*d* is meshed with the gear 54*c* and fixed to an output shaft of a motor 59M. When the gears 54*c*, 54*d* is rotated with a drive of the motor 59M, the pulley 54*b*2 is rotated. The roller 54*b* is then rotated with the rotation of the pulley 54*b*2, which rotates or circulates the belts 54. As a result, the sliders 52 are moved in the main scanning direction while supporting the wiper supporter 51*a*.

Figure 5A:
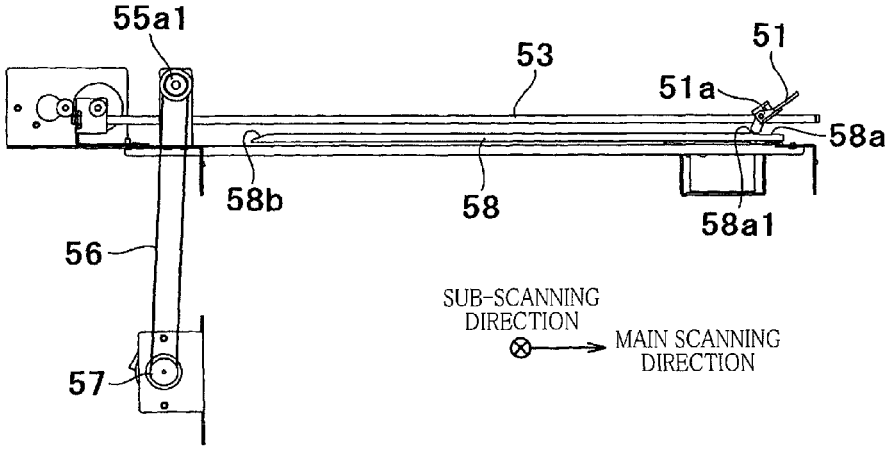
FIGS. 5*a*-5*g* are views for explaining an operation of a sub-wiper.

Further, the sub-wiping mechanism 50 includes a plate 58 as a component for rotating the sub-wiper 51. The plate 58 is a plate-like member elongated in the main scanning direction. The plate 58 is disposed under the wiper supporter 51*a* so as to be parallel to the horizontal plane. As shown in FIG. 5A, during the movement of the sub-wiper 51 in the main scanning direction, a lower end of the wiper supporter 51*a* is held in slidable contact with an upper face (a support face) of the plate 58.

The support face of the plate 58 is flat except for opposite end portions thereof in the main scanning direction. The plate 58 has a step face 58*a* provided at one of the opposite end portions thereof in the main scanning direction. Specifically, the step face 58*a* is provided at an upstream end portion of the plate 58 in a moving direction of the sub-wiper 51 (indicated by arrow in FIG. 4) in which the sub-wiper 51 is moved in its wiping operation. The plate 58 has an inclined face 58*b* provided at the other of the opposite end portions thereof in the main scanning direction. The step face 58*a* is a face lower in height than the support face of the plate 58 except its opposite end portions in the main scanning direction. A projecting portion 58*a*1 is provided on the support face of the plate 58 at a boundary between the step face 58*a* and the support face of the plate 58 except the step face 58*a*.

The sub-wiper cleaner 55*a* is a member formed e.g., by an absorber material such as a sponge for cleaning the sub-wiper 51 after the second wiping operation is finished. The sub-wiper cleaner 55*a* has a cylindrical shape extending in the sub-scanning direction and is supported by a shaft 55*b* extending in the sub-scanning direction. The shaft 55*b* is supported by the frame 62 so as to be rotatable together with the sub-wiper cleaner 55*a* about an axis extending in the sub-scanning direction. The sub-wiping mechanism 50 includes a pulley 57, a pulley 55*a*1, and a belt 56 as components for rotating the shaft 55*b*. The pulley 57 is fixed to an output shaft of a motor 51M, the pulley 55*a*1 is fixed to one end of the shaft 55*b*, and the belt 56 is wound around the pulley 57 and the pulley 55*a*1. When the pulley 57 is rotated with a drive of the motor 51M, the belt 56 is circulated or rotated, which rotates the pulley 55*a*1. As a result, the shaft 55*b* is rotated together with the sub-wiper cleaner 55*a* about the axis extending in the sub-scanning direction. The projecting portion 58*a*1 is movable between (a) a projecting position at which the projecting portion 58*a*1 projects upward from the support face of the plate 58 except its opposite end portions in the main scanning direction (that is, an upper end of the projecting portion 58*a*1 is located on an upper side of the support face of the plate 58 except its opposite end portions in the main scanning direction) and (b) a retracted position at which the projecting portion 58*a*1 is retracted downward so as to be located at the same height as the support face of the plate 58 except its opposite end portions in the main scanning direction. It is noted that the projecting portion 58*a*1 is urged upward, and accordingly the projecting portion 58*a*1 is located at the projecting position where an external force is not applied to the projecting portion 58*a*1.

Here, there will be explained an operation of the sub-wiper 51 in the second wiping operation. It is noted that the second wiping operation is an operation in which the sub-wiper 51 is moved in the main scanning direction while contacting the support face 8*a* to wipe and remove foreign materials from the support face 8*a*.

At times other than the second wiping operation, the sub-wiper 51 is at rest at its home position located at one end of the plate 58 in the main scanning direction, so as to face the support face 8*a* of the sheet-convey belt 8 in the upward and downward direction. In this state, the sub-wiper 51 is inclined at an angle at which a distal end thereof does not contact the support face 8*a*. Further, in this state, as shown in FIG. 5B, a lower end 51*a*1 of the wiper supporter 51*a* is held in contact with an inclined face of the step face 58*a* nearer to the projecting portion 58*a*1.

Figure 5B:
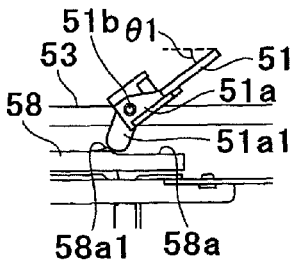
Figure 5C:
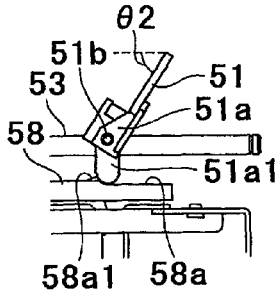
Figure 5D:
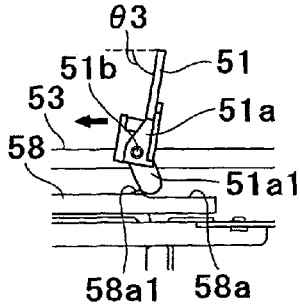

In the second wiping operation, when the sliders 52 are about to move in the main scanning direction with the drive of the motor 59M, as shown in FIGS. 5B, 5C, and 5D, the lower end 51*a*1 is rotated while contacting the above-mentioned inclined face of the projecting portion 58*a*1. As a result, the sub-wiper 51 is rotated together with the wiper supporter 51*a* against an urging force of the urging member about the axis extending in the sub-scanning direction such that the inclination angle of the sub-wiper 51 with respect to the horizontal plane gradually increases from an inclination angle θ1 to an inclination angle θ3, causing the distal end of the sub-wiper 51 to be brought into contact with the support face 8*a* of the sheet-convey belt 8. When the sliders 52 have been further moved in the main scanning direction, the projecting portion 58*a*1 is pushed downward by the lower end 51*a*1 to be moved to the retracted position at which the projecting portion 58*a*1 is located at the same height as the support face of the plate 58 except its opposite end portions in the main scanning direction.

Figure 5E:
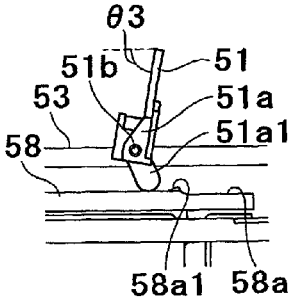
Figure 5F:
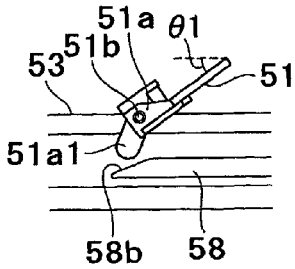

Then, when the sliders 52 have been further moved in the main scanning direction, as shown in FIG. 5E, the lower end 51*a*1 passes through the projecting portion 58*a*1, and the inclination angle of the sub-wiper 51 with respect to the horizontal plane becomes θ3 which is the largest angle among inclination angles of the sub-wiper 51 with respect to the horizontal plane. In this state, the urging force of the urging member (i.e., a force changing the inclination angle of the sub-wiper 51 from θ3 to θ1) is being acted on the sub-wiper 51 and the wiper supporter 51*a*, but the lower end 51*a*1 is supported by the support face of the plate 58, thereby keeping the inclination angle of the sub-wiper 51 at θ3. The sub-wiper 51 is then moved in the main scanning direction in the state in which the distal end thereof is held in contact with the support face 8*a*. When the sub-wiper 51 has reached the other end of the plate 58 in the main scanning direction, and the lower end 51*a*1 has reached the inclined face 58*b*, as shown in FIG. 5F, the lower end 51*a*1 is moved off or released from the support face of the plate 58 (i.e., the inclined face 58*b*). As a result, the urging force of the urging member rotates the sub-wiper 51 together with the wiper supporter 51*a* about the axis extending in the sub-scanning direction such that the inclination angle of the sub-wiper 51 with respect to the horizontal plane is changed from θ3 to θ1 again, thereby moving off or release the distal end of the sub-wiper 51 from the support face 8*a* of the sheet-convey belt 8. It is noted that a moving speed of the sub-wiper 51 in the main scanning direction is set so as to be greater than a relative moving speed of the main wiper 41 and the sheet-convey belt 8 in the first wiping operation for wiping the support face 8*a* by the main wiper 41.

Figure 5G:
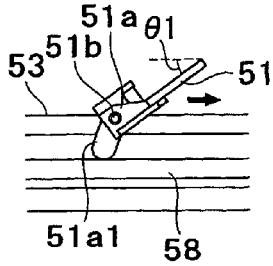

After the second wiping operation, the sub-wiper 51 is moved to a position at which the distal end thereof is brought into contact with the sub-wiper cleaner 55*a*, in a state in which the inclination angle of the sub-wiper 51 with respect to the horizontal plane is kept at θ1 such that the distal end of the sub-wiper 51 is distant from the support face 8*a*. Then, after the distal end of the sub-wiper 51 has been cleaned by the sub-wiper cleaner 55*a*, as shown in FIG. 5G, the sub-wiper 51 is moved toward its home position in the main scanning direction. The lower end 51*a*1 is brought into contact, near the home position, with an inclined face of the step face 58*a* farther from the projecting portion 58*a*1 and then passes through the projecting portion 58*a*1 while moving the projecting portion 58*a*1 downward. The sub-wiper 51 is then stopped at the home position in the state in which the inclination angle of the sub-wiper 51 with respect to the horizontal plane is kept at θ1 such that the distal end is distant from the support face 8*a*.

Each of an inclination angle θ2 and the inclination angle θ3 is set such that the distal end portion of the sub-wiper 51 contacts the support face 8*a* of the sheet-convey belt 8 while bending. Further, at the inclination angle θ3, a pressing force of the sub-wiper 51 with respect to the support face 8*a* of the sheet-convey belt 8 is set so as to be smaller than a pressing force of the main wiper 41 with respect to the support face 8*a* in the first wiping operation. Specifically, a distance between the support face 8*a* of the sheet-convey belt 8 and a shaft 51*b* as an axis about which the sub-wiper 51 is rotated is set so as to be larger than a distance between the support face 8*a* of the sheet-convey belt 8 and the shaft 42 as an axis about which the main wiper 41 is rotated. It is noted that, also in a case where the distance between the shaft 51 and the support face 8*a* and a distance between the shaft 42 and the support face 8*a* are the same as each other, the inclination angle of the sub-wiper 51 with respect to the horizontal plane in the second wiping operation may be set so as to be smaller than the inclination angle of the main wiper 41 with respect to the horizontal plane in the first wiping operation. That is, the inclination angle of the main wiper 41 with respect to the horizontal plane in the first wiping operation may be larger than θ3.

That is, a wiping ability of the sub-wiper 51 for wiping the foreign materials on the support face 8*a* is set to be smaller than that of the main wiper 41. Thus, a frictional force of the sub-wiper 51 and the support face 8*a* is relatively small in the second wiping operation. Accordingly, it is possible to prevent the sheet-convey belt 8 from moving or deviating in the main scanning direction by the movement of the sub-wiper 51 in the main scanning direction in the second wiping operation. Consequently, it is possible to prevent a lowering of a conveyance accuracy of the sheet-convey belt 8. Further, it is possible to reliably collect or gather foreign materials into a narrow area by the main wiper 41 having a large pressing force as will be described below, and it is possible to remove the foreign materials collected into the narrow area by the sub-wiper 51 having a small pressing force without moving or deviating the sheet-convey belt 8. It is noted that, even where the sub-wiper 51 has a relatively small pressing force, a desired amount of the foreign materials can be removed from the support face 8*a* by the sub-wiper 51 because the sub-wiper 51 is held in contact with the support face 8*a* of the sheet-convey belt 8 in the wiping operation. That is, what is removed by the sub-wiper 51 is foreign materials remaining on the support face 8*a* when the main wiper 41 is moved off from the support face 8*a* (i.e., the foreign materials collected into the narrow area by the main wiper 41), and there are few foreign materials having not been wiped by the sub-wiper 51 (i.e., foreign materials the sub-wiper 51 has failed to wipe), thereby causing few problems. Here, examples of the problems include the following: the foreign materials attached or adhering to the support face 8*a* are attached or adhere to a back face of the sheet P conveyed by the sheet-convey belt 8; and the foreign materials attached to the support face 8*a* lowers the attractive force of the sheet-convey belt 8 for the sheet P, making it impossible for the sheet-convey belt 8 to convey the sheet P.

Further, the components (such as the belts 54) for moving the sub-wiper 51 in the main scanning direction is disposed over the entire width of the sheet-convey belt 8. Thus, in the second wiping operation, the sub-wiper 51 is moved from one to the other end of the sheet-convey belt 8 in the widthwise direction thereof to remove the foreign materials on the entire width of the sheet-convey belt 8 in the state in which the distal end portion of the sub-wiper 51 is held in contact with the support face 8*a* of the sheet-convey belt 8 while bending. It is noted that the foreign materials removed by the wipers 41, 51 are received by a receiving plate(s) or tray(s) disposed under the wipers 41, 51.

Figure 6:
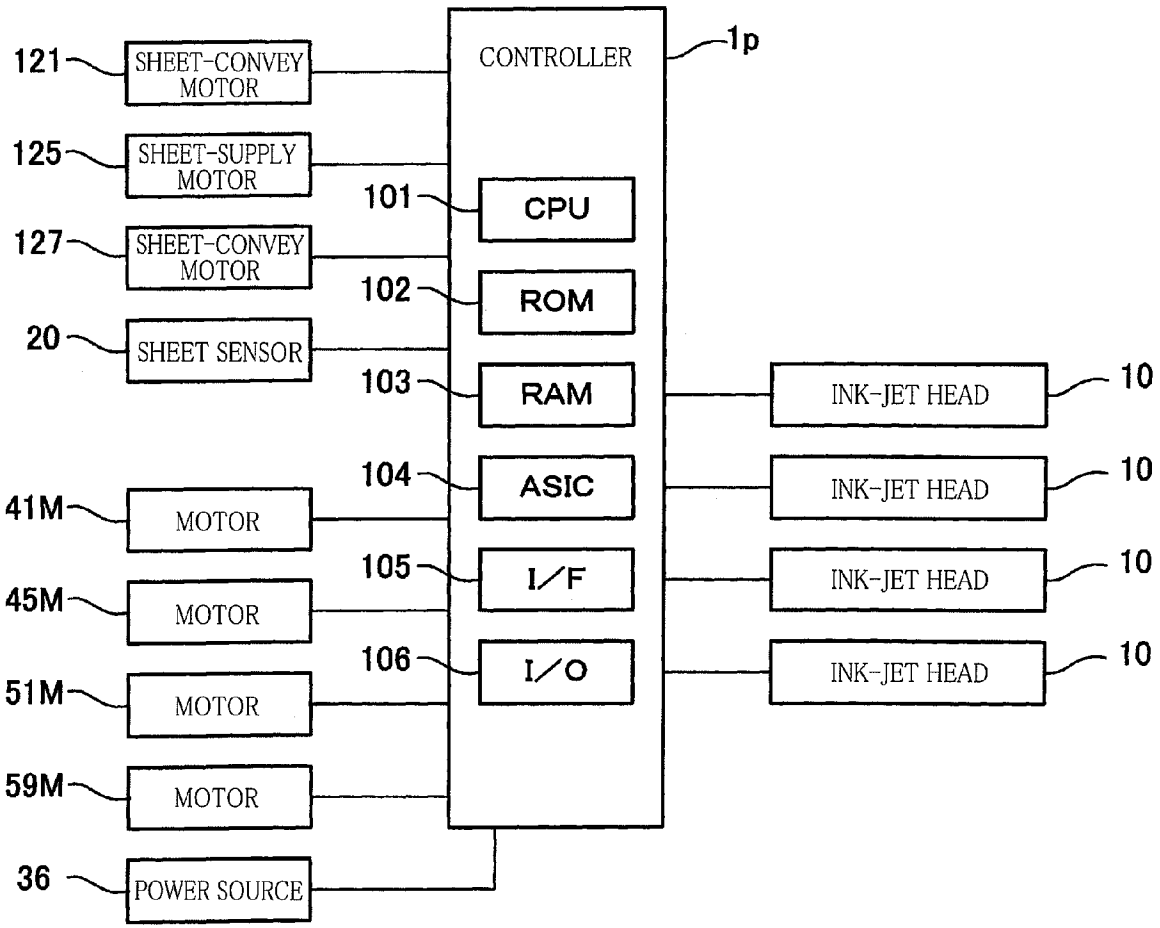
FIG. 6 is a block diagram showing an electric construction of the printer.
Figure 7:
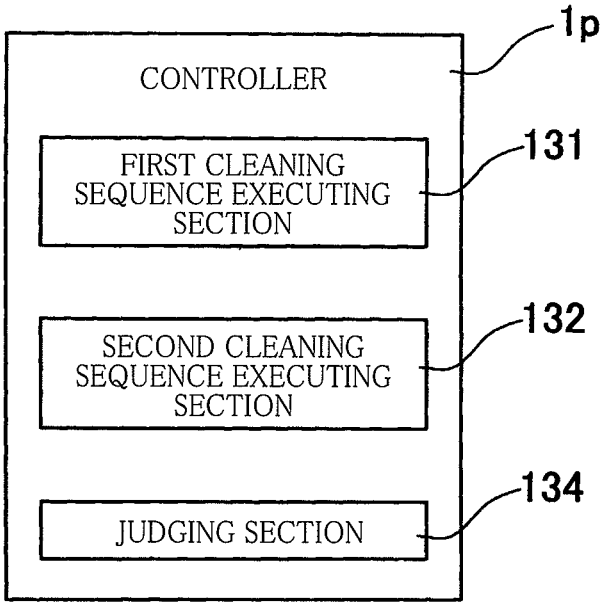
FIG. 7 is a block diagram showing a general configuration of a controller shown in FIG. 1.

There will be next explained an electric construction of the printer 1 with reference to FIGS. 6 and 7.

As shown in FIG. 6, the controller 1*p* includes a Central Processing Unit (CPU) 101, a Read Only Memory (ROM) 102, a Random Access Memory (RAM) 103 such as a non-volatile RAM, an Application Specific Integrated Circuit (ASIC) 104, an interface (I/F) 105, an Input/Output Port (I/O) 106, and so on. The ROM 102 stores therein programs executed by the CPU 101, various fixed data, and so on. The RAM 103 temporarily stores therein data required for the execution of the programs, such as image data relating to an image to be formed on the sheet P. The ASIC 104 performs, e.g., rewriting and sorting of the image data. Specifically, the ASIC 104 performs a signal processing and an image processing, for example. The I/F 105 transmits or receives data to or from the external device. The I/O 106 inputs or outputs detection signals of various sensors.

The controller 1*p* is connected to the motors 121, 125, 127, 41M, 45M, 51M, 59M, the sheet sensor 20, the power source 36, control boards for the respective heads 10, and so on. Further, as shown in FIG. 7, the controller 1*p* includes functioning sections constituted by the above-described hardware. Examples of the functioning sections include a first cleaning sequence executing section 131, a second cleaning sequence executing section 132, a judging section 134 (as one example of a determining section), and so on.

The first cleaning sequence executing section 131 controls the motor 41M and the sheet-convey motor 121 to perform the first wiping operation in which the distal end of the main wiper 41 located at a position distant from the support face 8*a* is brought into contact with the support face 8*a*, and then the main wiper 41 and the support face 8*a* are relatively moved in the conveying direction to wipe and remove the foreign materials on the support face 8*a*. It is noted that a first-wiping driving portion is constituted by a part of the main wiping mechanism 40 (including the motor 41M) for moving the main wiper 41 and a part of the sheet-convey unit 21 (including the sheet-convey motor 121) for rotating the sheet-convey belt 8.

The second cleaning sequence executing section 132 controls the motor 59M to perform the second wiping operation in which the distal end of the sub-wiper 51 located at a position distant from the support face 8*a* is brought into contact with the support face 8*a*, and then the sub-wiper 51 and the support face 8*a* are relatively moved in the main scanning direction to wipe and remove the foreign materials on the support face 8*a*. It is noted that a second-wiping driving portion is constituted by a part of the sub-wiping mechanism 50 (including the motor 59M) for moving the sub-wiper 51.

The judging section 134 judges that a first cleaning sequence (operation) including the first and second wiping operations is performed, where a length of a foreign-material attached area on the support face 8*a* is equal to or longer than that of the sub-wiper 51 in the sub-scanning direction (i.e., the conveying direction). The foreign-material attached area is an area on which the foreign materials are attached or adhere to the support face 8*a*. It is noted that the judging section 134 includes: (a) a first form (manner) for actually measuring a length of the foreign materials attached to the support face 8*a* in the conveying direction and then judging whether the length of the foreign materials attached to the support face 8*a* in the conveying direction is shorter than the length of the sub-wiper 51 or not; and (b) a second form (manner) for, on the basis of a type of operations to attach the ink to the sheet-convey belt 8, estimating whether the length of the foreign materials attached to the support face 8*a* in the conveying direction is shorter than the length of the sub-wiper 51 or not.

In the first form, the printer 1 includes a measuring portion or member (e.g., an image sensor) for actually measuring the length of the foreign-material attached area on the support face 8*a* in the conveying direction. The judging section 134 compares the length of the sub-wiper 51 with the length of the foreign-material attached area measured by the measuring portion. The judging section 134 then judges whether the length of the foreign materials attached to the support face 8*a* in the conveying direction is shorter than the length of the sub-wiper 51 or not, on the basis of a signal from the measuring portion.

In the second form, the judging section 134 estimates whether the length of the foreign materials attached to the support face 8*a* in the conveying direction is shorter than the length of the sub-wiper 51 or not, on the basis of the type of the operations to attach the ink to the sheet-convey belt 8. Examples of the operations to attach the ink to the sheet-convey belt 8 include paper jamming, purging, preliminary ejection, and the like. It is noted that the purging is an operation for applying a pressure to the ink in the head 10 by a drive of a pump to eject the ink from all ejection openings of the head 10. The preliminary ejection is an operation for ejecting the ink from the ejection opening(s) by a drive of an actuator of the head 10 on the basis of preliminary ejection data which is different from the image data.

There will be next explained the second form of the judging section 134 in detail. Where the purging has been performed toward the support face 8*a* of the sheet-convey belt 8, or where jamming of the sheet P has occurred, the judging section 134 estimates that the length of the foreign-material attached area on the support face 8*a* is equal to or longer than the length of the sub-wiper 51 and determines to perform the first cleaning sequence. This is for the following reasons: a large amount of foreign materials are attached to the support face 8*a* where the purging has been performed toward the support face 8*a* of the sheet-convey belt 8, and accordingly it is estimated that the length of the foreign-material attached area is likely to be equal to or longer than the length of the sub-wiper 51. Further, where the jamming has occurred, it is estimated that the head 10 ejects the ink even though the sheet P is not conveyed, and accordingly the foreign materials are attached to the support face 8*a* over an area thereof equal to or longer than the length of the sub-wiper 51. It is noted that the first cleaning sequence is a sequence in which the first wiping operation is performed, and then the second wiping operation is performed to wipe the foreign materials remaining on the support face 8*a* when the main wiper 41 is disengaged from the support face 8*a*.

On the other hand, where the judging section 134 has estimated that the length of the foreign-material attached area in the sub-scanning direction is shorter than the length of the sub-wiper 51, the judging section 134 determines to perform a second cleaning sequence (operation). Specifically, where the preliminary ejection has been performed, the judging section 134 estimates the length of the foreign-material attached area on the support face 8*a* is shorter than the length of the sub-wiper 51. This is because the preliminary ejection in this form is controlled to be performed onto the liquid repellent area 8*b*, and accordingly it is estimated that the length of the foreign-material attached area is shorter than the sub-wiper 51. It is noted that the judging section 134 performs the first cleaning sequence where an amount of the ink equal to or larger than a specific amount has been ejected from the head 10 onto the support face 8*a* in the preliminary ejection. Here, where the amount of the ink equal to or larger than the specific amount has been ejected, some amount of foreign materials remain on the support face 8*a* after the sub-wiper 51 has wiped foreign materials attached to an area having a length shorter than the length of the sub-wiper 51. That is, where an amount of the ink smaller than the specific amount has been ejected from the head 10 onto the support face 8*a*, that is, only where the sub-wiper 51 can wipe all the foreign materials, the judging section 134 determines to perform the second cleaning sequence. It is noted that the second cleaning sequence is a sequence in which the second wiping operation is performed to wipe foreign materials on the liquid repellent area 8*b* without performing the first wiping operation.

Figure 8:
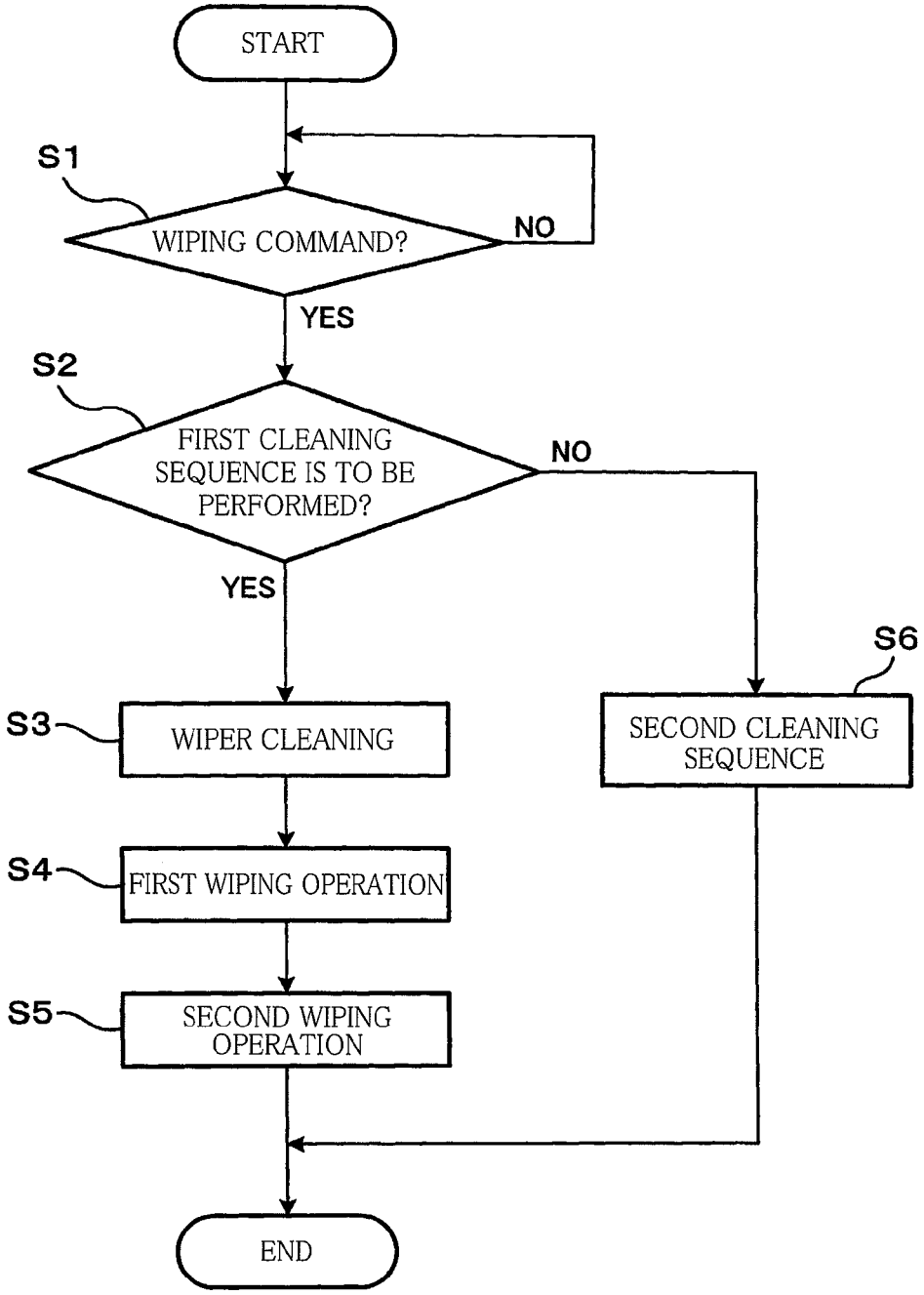
FIG. 8 is a flow-chart showing content of a maintenance executed by the controller of the printer.

There will be next explained the maintenance processing executed by the controller 1*p* with reference to FIG. 8. Processings explained below are executed by the CPU 101 in accordance with the programs stored in the ROM 102.

As shown in FIG. 8, initially in S1, the controller 1*p* judges whether the wiping command has been received or not. The controller 1*p* receives the wiping command where the purging or the preliminary ejection has been performed toward the support face 8*a* after a main power of the printer 1 has been turned on, where the jamming has occurred, and so on, for example.

Where the controller 1*p* has not received the wiping command (S1: NO), the controller 1*p* continues its waiting state. Where the controller 1*p* has received the wiping command (S1: YES), this maintenance processing goes to S2. In S2, the judging section 134 judges whether the first cleaning sequence is to be performed or not. That is, where the purging has been performed or where the jamming has occurred, the judging section 134 determines to perform the first cleaning sequence (S2: YES), and this maintenance processing goes to S3. On the other hand, where an amount of the ink smaller than the specific amount has been ejected in the preliminary ejection, the judging section 134 determines to perform the second cleaning sequence in which the first wiping operation is not performed (S2: NO), and this maintenance processing goes to S6. It is noted that even in the case where the purging has been performed or the jamming has occurred, where the judging section 134 has estimated that the amount of the ink ejected from the head 10 is smaller than the specific amount, and the length of the foreign-material attached area is shorter than the length of the sub-wiper 51, the judging section 134 may determine to perform the second cleaning sequence. For example, where the jamming has occurred, the judging section 134 makes the estimation on the basis of the image data.

In S3, the controller 1*p* controls the motor 41M to be driven in the state in which the sheet-convey belt 8 is stopped or at rest, thereby rotating the main wiper 41 360 degrees in the clockwise direction in FIG. 1 about the axis extending in the main scanning direction. In this rotation, the distal end of the main wiper 41 is held in contact with an outer circumferential face of the wiper cleaner 45 while bending. Thus, the foreign materials attached or adhering to the distal end of the main wiper 41 are attached or adhere to the wiper cleaner 45, thereby removing the foreign materials from the distal end of the main wiper 41. That is, the wiper cleaning is performed.

It is noted that the controller 1*p* controls the wiper cleaner 45 to be rotated by a specific angle smaller than 360 degrees each time or several times when the wiper cleaning has been finished in S3. As a result, a portion of the wiper cleaner 45 which contacts the distal end of the main wiper 41 in each wiper cleaning is changed, thereby effectively removing the foreign materials attached or adhering to the distal end of the main wiper 41.

Then, in S4, the first cleaning sequence executing section 131 controls the drive of the sheet-convey motor 121 to rotate the sheet-convey belt 8 and then stops the drive of the sheet-convey motor 121 at a position at which the liquid repellent area 8*b* faces the main wiper 41, specifically at a timing when a specific position on the liquid repellent area 8*b* faces the distal end of the main wiper 41. Here, the specific position is located at a central portion of the liquid repellent area 8*b* in the sub-scanning direction. Then, the first cleaning sequence executing section 131 drives the motor 41M to rotate the main wiper 41 slightly about the axis extending in the main scanning direction, whereby the distal end of the main wiper 41 located at the position distant from the support face 8*a* is brought into contact with the liquid repellent area 8*b*. The first cleaning sequence executing section 131 then stops the drive of the motor 41M at a timing when the distal end of the main wiper 41 is brought into contact with the support face 8*a* while bending. The first cleaning sequence executing section 131 then drives the sheet-convey motor 121 again to rotate the sheet-convey belt 8 360 degrees or more. As a result, the main wiper 41 collects the foreign materials on the support face 8*a* into the narrow area of the support face 8*a* to remove the foreign materials. That is, the first wiping operation is performed. After the sheet-convey belt 8 has rotated 360 degrees or more, the first cleaning sequence executing section 131 stops the drive of the sheet-convey motor 121 when the distal end of the main wiper 41 is held in contact with the specific position of the liquid repellent area 8*b*. Then, the first cleaning sequence executing section 131 drives the motor 41M in the state in which the sheet-convey belt 8 is stopped, thereby rotating the main wiper 41 slightly about the axis extending in the main scanning direction to release the distal end of the main wiper 41 from the specific position of the liquid repellent area 8*b*. It is noted that, in the present embodiment, after the first wiping operation, the main wiper 41 contacting the liquid repellent area 8*b* is always released at the specific position of the liquid repellent area 8*b*.

Then, in S5, the second cleaning sequence executing section 132 drives the sheet-convey motor 121 to rotate the sheet-convey belt 8 and stops the drive of the sheet-convey motor 121 at a position at which the liquid repellent area 8*b* and the sub-wiper 51 face each other, i.e., at a timing when the liquid repellent area 8*b* has reached a position over the sub-wiper 51. That is, as shown in FIG. 1, when the ink-jet printer 1 is seen in the main scanning direction, the liquid repellent area 8*b* is disposed on an upper side of the sub-wiper 51. In this operation, the rotation of the sheet-convey belt 8 is stopped at a timing when a central portion of the sub-wiper 51 and a central portion of the liquid repellent area 8*b* coincide with each other in the sub-scanning direction. Here, as described above, the length of the liquid repellent area 8*b* in the conveying direction (in the sub-scanning direction) is shorter than that of the sub-wiper 51 in the conveying direction. Accordingly, the sub-wiper 51 can wipe an entire area of the liquid repellent area 8*b* by moving in the main scanning direction in the state in which the central portion of the sub-wiper 51 in the conveying direction and the central area of the liquid repellent area 8*b* in the conveying direction coincide with each other.

The second cleaning sequence executing section 132 then drives the motor 59M in a forward direction. As a result, the distal end of the sub-wiper 51 located at the position distant from the support face 8*a* is brought into contact with the support face 8*a* (i.e., the liquid repellent area 8*b*), and then the sub-wiper 51 is moved from the home position in the main scanning direction, whereby the foreign materials on the liquid repellent area 8*b* (i.e., the foreign materials remaining on the support face 8*a* after the main wiper 41 has been released from the support face 8*a*, i.e., the liquid repellent area 8*b*) are removed by the sub-wiper 51 while collected into the narrow area of the liquid repellent area 8*b*. That is, the second wiping operation is performed. The second cleaning sequence executing section 132 then temporarily stops the drive of the motor 59M at the timing when the sub-wiper 51 has reached the other end of the plate 58 in the main scanning direction. At this time, the distal end of the sub-wiper 51 is distant from the support face 8*a* (see FIG. 5F) and held in contact with the sub-wiper cleaner 55*a*. The second cleaning sequence executing section 132 then drives the motor 59M in a reverse direction to reversely move the sub-wiper 51 in the main scanning direction, i.e., in a direction opposite or reverse to the moving direction of the sub-wiper 51 indicated by arrow in FIG. 4 when the foreign materials are removed (see FIG. 5G). The second cleaning sequence executing section 132 then stops the drive of the motor 59M at a timing when the sub-wiper 51 has reached the home position, and the first and second wiping operations are finished.

On the other hand, where this maintenance processing goes from S2 to S6, the second cleaning sequence executing section 132 in S6 drives the sheet-convey motor 121 to rotate the sheet-convey belt 8 and then stops the drive of the sheet-convey motor 121 to stop the rotation of the sheet-convey belt 8 at the timing when the central portion of the sub-wiper 51 and the central portion of the liquid repellent area 8*b* coincide with each other in the sub-scanning direction as in S5. The second cleaning sequence executing section 132 then drives the motor 59M in the forward direction. As a result, the distal end of the sub-wiper 51 located at the position distant from the support face 8*a* is brought into contact with the support face 8*a* (i.e., the liquid repellent area 8*b*), and then the sub-wiper 51 is moved from the home position in the main scanning direction, whereby the foreign materials on the liquid repellent area 8*b* (i.e., the foreign materials such as the ink attached to the liquid repellent area 8*b* in the preliminary ejection) are removed by the sub-wiper 51 while collected into the narrow area of the liquid repellent area 8*b* (the second cleaning sequence). That is, the foreign materials on the liquid repellent area 8*b* are wiped without the first wiping operation (that is, the second wiping operation is performed). The second cleaning sequence executing section 132 then temporarily stops the drive of the motor 59M at the timing when the sub-wiper 51 has reached the other end of the plate 58 in the main scanning direction. At this time, the distal end of the sub-wiper 51 is distant from the support face 8*a* (see FIG. 5F) and held in contact with the sub-wiper cleaner 55*a*. The second cleaning sequence executing section 132 then drives the motor 59M in the reverse direction to reversely move the sub-wiper 51 in the main scanning direction, i.e., in the direction opposite or reverse to the moving direction of the sub-wiper 51 indicated by arrow in FIG. 4 when the foreign materials are removed (see FIG. 5G). The second cleaning sequence executing section 132 then stops the drive of the motor 59M at the timing when the sub-wiper 51 has reached the home position, and the second cleaning sequence is finished.

As described above, the first cleaning sequence is performed such that the second wiping operation is performed after the first wiping operation. Thus, the foreign materials remaining on the liquid repellent area 8*b* after the first wiping operation are removed. Accordingly, the foreign materials are less likely to remain on the support face 8*a* of the sheet-convey belt 8. As a result, when the sheet P is conveyed by the sheet-convey belt 8, the foreign materials to be attached to a face (the back face) of the sheet P which faces to the support face 8*a* can be reduced, thereby preventing the sheet P from being soiled.

Further, the controller 1*p* includes the judging section 134 and selects one of the first and second cleaning sequences on the basis of the judgment of the judging section 134. Thus, it is possible to effectively shorten a maintenance time required for the wiping operation. That is, where the preliminary ejection has been performed onto the liquid repellent area 8*b*, it is possible to perform only the second wiping operation (i.e., the second cleaning sequence), thereby making shorter a maintenance time than a maintenance time required for the first cleaning sequence in which both of the first and second wiping operations are performed.

Further, only where the ink having the amount smaller than the specific amount is ejected, the judging section 134 determines to perform the second cleaning sequence. Accordingly, it is possible to reliably remove the foreign materials including the ink from the support face 8*a*.

Further, the support face 8*a* has the liquid repellent area 8*b* formed thereon. Thus, even where the sub-wiper 51 having the relatively small pressing force is used to wipe the foreign materials on the liquid repellent area 8*b*, the sub-wiper 51 can easily remove the foreign materials from the liquid repellent area 8*b*. Accordingly, the foreign materials are less likely to remain on the support face 8*a*. Further, since the liquid repellent area 8*b* is formed, the moving speed of the sub-wiper 51 in the second wiping operation is higher than the relative moving speed of the main wiper 41 and the sheet-convey belt 8 in the first wiping operation. Thus, even where the wiping performance of the sub-wiper 51 is lowered, the foreign materials are less likely to remain on the liquid repellent area 8*b*. Accordingly, it is possible to shorten the time required for the maintenance operation while maintaining its cleaning ability.

Further, after the first wiping operation, the first cleaning sequence executing section 131 controls the main wiper 41 contacting the specific position of the liquid repellent area 8*b* to be moved off from the support face 8*a* every time when the main wiper 41 is moved off from the support face 8*a*. That is, the first cleaning sequence executing section 131 controls the main wiper 41 to be released from the support face 8*a* at the liquid repellent area 8*b* narrower than the sheet P in the conveying direction. Thus, even where some amount of foreign materials remain after the sub-wiper 51 has wiped the foreign materials remaining when the main wiper 41 had been moved off from the support face 8*a*, it is possible to prevent the attractive force of the sheet P from lowering in an entirety of the support face 8*a* because an area of the liquid repellent area 8*b* on which the some amount of foreign materials remain is narrower than the sheet P. Where the ink is attached to a certain area of the support face 8*a* of the sheet-convey belt 8, when the voltage is applied to the electrodes 33, 34, a current is more likely to flow on the wet certain area of the support face 8*a*, thereby lowering the attractive force between the sheet-convey belt 8 and the sheet P. However, since the wet certain area of the support face 8*a* is narrower than the sheet P, it is possible to prevent the attractive force from lowering even where the sheet P is adsorbed to the support face 8*a* at the wet certain area thereof. It is noted that, in the present embodiment, the main wiper 41 is moved off from the support face 8*a* at the specific position of the liquid repellent area 8*b*, but this printer 1 may be configured such that a specific area narrower than the sheet P is determined on the support face 8*a*, and instead of the liquid repellent area 8*b*, the main wiper 41 is moved off from the support face 8*a* at the specific area. Where the printer 1 is thus configured, the same advantages as described above can be obtained. Further, this narrow specific area may be set as an area to which the ink is attached in the preliminary ejection. Further, the specific area may be wider than the liquid repellent area 8*b*. Further, in the present embodiment, the specific position of the liquid repellent area 8*b* is located at the central portion of the liquid repellent area 8*b* in the sub-scanning direction in the above-described embodiment, but the specific position may be any position in the liquid repellent area 8*b*.

It is noted that, in the above-described embodiment, since the specific position at which the main wiper 41 is moved off from the support face 8*a* is set as a portion in the liquid repellent area 8*b*, and the length of the sub-wiper 51 in the conveying direction is longer than the liquid repellent area 8*b* in the conveying direction, the sub-wiper 51 can remove the foreign materials remaining on the support face 8*a* after the main wiper 41 has been moved off from the support face 8*a*. However, the present invention is not limited to this configuration. The foreign materials remaining on the support face 8*a* after the main wiper 41 has been moved off from the support face 8*a* are attached to the specific position and its vicinity (i.e., an area around the specific position). The length of the sub-wiper 51 in the conveying direction may be determined as any length as long as the sub-wiper 51 can remove the remaining foreign materials from the support face 8*a*. In view of the above, the sub-wiper 51 can remove the remaining foreign materials attached to the support face 8*a* by moving once in the main scanning direction as long as the sub-wiper 51 has such a length in the conveying direction that the sub-wiper 51 can wipe at least the specific position and its vicinity in the main scanning direction. Accordingly, the length of the sub-wiper 51 in the conveying direction may be shorter than the length of the liquid repellent area 8*b* in the conveying direction. Further, where the length of the specific position in the conveying direction is equal to or shorter than the length of the sub-wiper 51 in the conveying direction, the sheet-convey belt 8 is preferably moved in the second wiping operation such that the specific position and its vicinity are disposed in a range of the length the sub-wiper 51 in the conveying direction before the sub-wiper 51 is brought into contact with the support face 8*a*. In this case, even where the central portion of the sub-wiper 51 in the conveying direction and the central portion of the liquid repellent area 8*b* in the conveying direction do not coincide with each other as in the above-described embodiment, one movement of the sub-wiper 51 in the main scanning direction can remove the remaining foreign materials attached to the support face 8*a*.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, the controller 1*p* includes the judging section 134, but the judging section 134 may be omitted, and when the wiping command has been received, the first cleaning sequence may be performed to perform the first and second wiping operations. This simplifies the controlling configuration.

The main wiper 41 may extend in a direction intersecting the main and sub-scanning directions. Further, the sub-wiper 51 may extend in a direction intersecting the main and sub-scanning directions. Further, the sub-wiper 51 may be moved in the direction intersecting the main and sub-scanning directions in the second wiping operation.

In the first wiping operation, the main wiper 41 may be moved in the sub-scanning direction in a state in which the sheet-convey belt 8 is at rest or in a state in which the sheet-convey belt 8 is being rotated. Further, in the first wiping operation, the sheet-convey belt 8 may be rotated less than 360 degrees in the state in which the distal end of the main wiper 41 is held in contact with the support face 8*a*.

The conveying member is not limited to the sheet-convey belt. For example, a rotating drum may be used as the conveying member. Each of the main wiper and the sub-wiper is not limited to have the plate-like shape but may have various shapes as long as each of the main wiper and the sub-wiper removes the foreign materials on the support face by moving relative to the support face in the state in which the distal end is held in contact with the support face of the conveying member.

The present invention is applicable to any of a line printer and a serial printer. Further, the application of the present invention is not limited to the printer, and the present invention is applicable to a facsimile machine, a copying machine, and the like and applicable to a recording apparatus configured to perform recording by ejecting liquid other than the ink. Further, the application of the present invention is not limited to the ink-jet recording apparatus, and the present invention is applicable to a laser or thermal recording apparatus, for example. The recording medium is not limited to the sheet P, and various recording media may be used.

What is claimed is:

1. An image recording apparatus including a wiping mechanism for wiping a conveying member, the image recording apparatus comprising:

a head configured to eject liquid onto a recording medium;

the conveying member which has a support face facing the head and which is configured to convey the recording medium in a conveying direction by moving the support face supporting the recording medium thereon in the conveying direction;

a first wiper extending in a direction intersecting the conveying direction;

a second wiper extending at least in the conveying direction;

a first-wiping driving portion configured to drive the first wiper and the conveying member to perform a first wiping operation for:

adjusting a position of the conveying member;

bringing a distal end of the first wiper located at a position distant from the support face, into contact with the support face; and moving the first wiper and the support face relative to each other in the conveying direction;

a second-wiping driving portion configured to drive the second wiper and the conveying member to perform a second wiping operation for:

adjusting the position of the conveying member;

bringing a distal end of the second wiper located at a position distant from the support face, into contact with the support face; and moving the second wiper and the support face relative to each other in a direction intersecting the conveying direction; and a controller configured to control the first-wiping driving portion and the second-wiping driving portion;

wherein the controller is configured to control the first-wiping driving portion and the second-wiping driving portion to perform a first cleaning operation including the first wiping operation and the second wiping operation which is performed after a completion of the first wiping operation; and wherein the controller is configured to control the second-wiping driving portion in the second wiping operation such that the second wiper wipes the support face to remove a foreign material remaining on the support face when the first wiper is released from the support face in the first wiping operation.

2. The image recording apparatus according to claim 1, wherein the controller controls the second-wiping driving portion in the second wiping operation such that the second wiper wipes at least a specific position on the support face and a vicinity of the specific position, wherein the specific position is located at a position on the support face at which the distal end of the first wiper is released from the support face in the first wiping operation.

3. The image recording apparatus according to claim 2, wherein the controller is configured to move the conveying member such that the specific position and the vicinity thereof are disposed in a range of a length of the second wiper in the conveying direction before the second wiper is brought into contact with the support face in the second wiping operation.

4. The image recording apparatus according to claim 1, wherein the controller includes a determining section configured to determine to:

perform the first cleaning operation where a length of a foreign-material attached area of the support face in the conveying direction is equal to or longer than a length of the second wiper in the conveying direction, wherein the foreign-material attached area is an area of the support face to which foreign materials are attached; and perform a second cleaning operation where the length of the foreign-material attached area in the conveying direction is shorter than the length of the second wiper in the conveying direction, wherein the second cleaning operation in an operation in which the second wiping operation is performed without performing the first wiping operation, and wherein the controller is configured to perform the first cleaning operation or the second cleaning operation on the basis of the determination of the determining section.

5. The image recording apparatus according to claim 4, wherein the determining section is configured to estimate whether the length of the foreign-material attached area in the conveying direction is shorter than the length of the second wiper in the conveying direction or not on the basis of a manner of the ejection of the liquid onto the support face.

6. The image recording apparatus according to claim 5, wherein the determining section is configured to estimate that the length of the foreign-material attached area in the conveying direction is equal to or longer than the length of the second wiper in the conveying direction where a pump connected to the head has applied a power to the liquid and thereby the liquid has been ejected onto the support face.

7. The image recording apparatus according to claim 5, wherein the determining section is configured to estimate that the length of the foreign-material attached area in the conveying direction is equal to or longer than the length of the second wiper in the conveying direction where the recording medium is not located at a position facing the head and where the liquid has been ejected onto the support face on the basis of image data based on which an image is recorded on the recording medium.

8. The image recording apparatus according to claim 5, wherein the determining section is configured to estimate that the length of the foreign-material attached area in the conveying direction is shorter than the length of the second wiper in the conveying direction where an actuator connected to the head has applied a power to the liquid and thereby the liquid has been ejected onto the support face on the basis of preliminary ejection data different from image data based on which an image is recorded on the recording medium, wherein the preliminary ejection data is data based on which ejection not contributing to the recording of the image is performed.

9. The image recording apparatus according to claim 4, wherein the determining section is configured to determine to perform the second cleaning operation where an amount of the liquid having been ejected from the head onto the support face is equal to or smaller than a specific amount.

10. The image recording apparatus according to claim 1, wherein a pressing force of the second wiper with respect to the support face in the second wiping operation is smaller than a pressing force of the first wiper with respect to the support face in the first wiping operation.

11. The image recording apparatus according to claim 1, wherein a liquid repellent area is formed on the support face of the conveying member, the liquid repellent area extending in a direction intersecting the conveying direction and having a higher liquid repellency than that of the other area of the support face, wherein the controller is configured to control the first-wiping driving portion such that a specific position on the support face is included in the liquid repellent area, wherein the specific position is located at a position at which the first wiper is released from the support face after the completion of the first wiping operation, and wherein the controller is configured to control the second-wiping driving portion in the second wiping operation such that the second wiper wipes the liquid repellent area.

12. The image recording apparatus according to claim 11, wherein a length of the second wiper in the conveying direction is longer than a length of the liquid repellent area in the conveying direction.

13. The image recording apparatus according to claim 12, wherein the controller is configured to move the conveying member such that the liquid repellent area is disposed in a range of a length of the second wiper in the conveying direction before the second wiper is brought into contact with the support face in the second wiping operation.

14. The image recording apparatus according to claim 12, wherein the controller is configured to move the conveying member such that a central portion of the second wiper in the conveying direction coincides with a central portion of the liquid repellent area in the conveying direction.

15. The image recording apparatus according to claim 11, wherein the controller is configured to control the first-wiping driving portion such that the specific position is located in the liquid repellent area in the conveying direction.

16. The image recording apparatus according to claim 15, wherein the first wiper extends in a direction perpendicular to the conveying direction, and wherein the controller is configured to control the first-wiping driving portion such that the specific position is located at a central portion of the liquid repellent area in the conveying direction.

17. The image recording apparatus according to claim 1, further comprising an adsorption mechanism configured to electrostatically adsorb the recording medium to the support face of the conveying member, wherein the support face has a specific area having a length shorter in the conveying direction than a length of the recording medium, and wherein the controller is configured to control the first-wiping driving portion such that the first wiper is released from the support face in the specific area.

* * * * *